US011638882B2

(12) United States Patent
Wang

(10) Patent No.: US 11,638,882 B2
(45) Date of Patent: May 2, 2023

(54) WALL-CLIMBING VEHICLE AND BOTTOM COVER OF SUCH VEHICLE

(71) Applicant: Shantou Chenghai Lichengfeng Plastic Products Factory, Shantou (CN)

(72) Inventor: Lixiong Wang, Shantou (CN)

( * ) Notice: Subject to any disclaimer, the term of this patent is extended or adjusted under 35 U.S.C. 154(b) by 311 days.

(21) Appl. No.: 16/858,639

(22) Filed: Apr. 26, 2020

(65) Prior Publication Data

US 2020/0254355 A1 Aug. 13, 2020

(51) Int. Cl.
*A63H 17/26* (2006.01)
*A63H 30/04* (2006.01)
*A63H 29/22* (2006.01)

(52) U.S. Cl.
CPC ..... *A63H 17/262* (2013.01); *A63H 30/04* (2013.01); *A63H 29/22* (2013.01)

(58) Field of Classification Search
CPC .. A63H 17/002; A63H 17/262; A63H 17/266; A63H 27/12; A63H 29/10; A63H 29/22; A63H 29/24; A63H 30/04
USPC ..... 446/237, 448, 454, 456
See application file for complete search history.

(56) References Cited

U.S. PATENT DOCUMENTS 3,810,515 A * 5/1974 Ingro ..... A63H 11/04 446/457
3,926,277 A * 12/1975 Shino ..... A47L 5/36 180/164
4,306,375 A * 12/1981 Goldfarb ..... A63H 17/12 446/438
4,511,343 A * 4/1985 Goldfarb ..... A63H 29/22 446/457
4,971,591 A * 11/1990 Raviv ..... A63H 17/26 180/164
5,194,032 A * 3/1993 Garfinkel ..... A63H 17/004 446/178
5,542,630 A * 8/1996 Savill ..... B63B 1/34 244/209
6,923,277 B2 * 8/2005 Lin ..... B60L 50/52 180/2.2
7,753,755 B2 * 7/2010 Clark, Jr. ..... B62D 37/02 446/178
7,980,916 B2 * 7/2011 Clark, Jr. ..... B62D 37/02 446/178
8,371,564 B2 * 2/2013 Asada ..... B23Q 3/088 269/21

(Continued)

*Primary Examiner* — Joseph B Baldori
(74) *Attorney, Agent, or Firm* — Rumit Ranjit Kanakia

(57) ABSTRACT

A wall-climbing vehicle having a bottom cover configured along a bottom portion. The bottom cover is disposed along the bottom portion such that a gap between the vertical wall and the bottom portion of the wall-climbing vehicle is formed. An air intake area is configured along a middle portion of the bottom cover to enable symmetrical weight balance. The air intake area is configured to accommodate a circular air intake arrangement that includes a circular configuration to create a large opening along the air intake area to increase an air suction volume along the air intake area. The wall-climbing vehicle includes a plurality of sealing cloths strips configured along sides the bottom portion to form a closed area in the wall-climbing vehicle to be continuously evacuated to form a negative pressure. Moreover, a plurality of bumps and a plurality of dots may be provided for balancing effect.

14 Claims, 3 Drawing Sheets

(56) References Cited

U.S. PATENT DOCUMENTS

| | | | | |
|---|---|---|---|---|
| 8,979,609 | B2 * | 3/2015 | Clark, Jr. | A63H 30/04 446/178 |
| 9,019,467 | B2 * | 4/2015 | Owa | G03B 27/58 355/72 |
| 9,675,897 | B2 * | 6/2017 | Clark, Jr. | A63H 30/04 |
| 10,112,664 | B2 * | 10/2018 | Li | B25J 15/06 |
| 10,220,640 | B2 * | 3/2019 | Tsuruoka | B41J 11/007 |
| 10,220,896 | B2 * | 3/2019 | Kazakov | B62D 57/024 |
| 10,398,995 | B2 * | 9/2019 | Clark, Jr. | A63H 17/262 |
| 10,518,830 | B2 * | 12/2019 | Beard, III | B62D 57/024 |
| 10,836,446 | B2 * | 11/2020 | Sekiguchi | B60D 3/00 |
| 11,130,069 | B1 * | 9/2021 | Lin | A63H 29/24 |
| 11,260,312 | B1 * | 3/2022 | Asano | A63H 17/28 |
| 2009/0203292 | A1 * | 8/2009 | Clark, Jr. | B62D 57/024 446/454 |
| 2018/0050747 | A1 * | 2/2018 | Kazakov | B62D 55/265 |
| 2020/0254355 | A1 * | 8/2020 | Wang | A63H 29/24 |

* cited by examiner

WALL-CLIMBING VEHICLE AND BOTTOM COVER OF SUCH VEHICLE

FIELD OF THE DISCLOSURE

The present disclosure relates to a toy industry, and, more particularly, to a wall-climbing toy vehicle, and a bottom cover of such vehicle.

BACKGROUND OF THE DISCLOSURE

Wall-climbing toy vehicles are a new attraction among people, especially among children. Designing and manufacturing of the wall-climbing toy vehicles is a work of putting several scientific principles together. Designing and manufacturing a wall-climbing toy vehicle involves a lot of influence from science and that is why has been a field of constant innovation. More often than not, the user specially buys wall-climbing toy vehicle, which may exhibit characteristics like good withholding of car on wall, good maneuverability on the wall and so forth.

Whenever user chooses a wall-climbing toy vehicle, he/she is left over with lot of conventional wall-climbing toy vehicle in the market. Such conventional wall-climbing toy vehicles may be effective in meeting various requirements but may not be able to address some of the specific problems. For example, there may be the conventional wall-climbing toy vehicle which may climb on the wall but fall off the wall frequently due to less suction effect. Generally, such wall-climbing cars includes a bottom cover having a hole which enables air flow therefrom via a fan-motor assembly placed along the hole. Such hole may not be properly aligned or sized; or the fan-motor assembly may not be properly placed or aligned of along the hole. As a result, the conventional wall-climbing toy vehicle may not have sufficient air suction volume, thereby losing balance over the wall while climbing and may break upon repeated fall.

Further, there may be the conventional wall-climbing toy vehicle which may not be maneuvered on the curved section of the wall. For example, even if the convention wall-climbing vehicles may be designed to have greater suction volume, such wall-climbing vehicle with greater suction volume may not be able to have better maneuverability due to increased suction volume as bottom cover of such conventional wall-climbing toy vehicle may include plane and smooth surfaces.

Furthermore, there may be the conventional wall-climbing toy vehicle which may have less ground clearance with respect to the wall. As a result, the wall-climbing toy vehicle may not be able to climb the wall if any small obstacle comes in between.

Accordingly, there exists a need to overcome shortcomings of the existing wall-climbing toy vehicle. For example, there exists a need of a wall-climbing toy vehicle which may create substantial amount of suction effect to withhold the wall during climbing the wall. Further, there is need of such wall-climbing toy vehicle which may be able to balance with greater suction volume and be maneuverable on the curved section of the wall with ease. Further, there is need of such wall-climbing toy vehicle which may cross the obstacles coming between the wall and the wall-climbing toy vehicle, while climbing the wall. In this way, the user may get a wall-climbing toy vehicle which can climb the wall effectively without facing any hindrance.

SUMMARY OF THE DISCLOSURE

In view of the foregoing disadvantages inherent in the prior art, the general purpose of the present disclosure is to provide a wall-climbing vehicle, and a bottom cover of such vehicle, to include all advantages of the prior art, and to overcome the drawbacks inherent in the prior art.

An object of the present disclosure is to provide a wall-climbing toy vehicle which may create substantial amount of suction effect to withhold the wall during climbing the wall.

An object of the present disclosure is to provide a wall-climbing toy vehicle which may be able to balance with greater suction volume and be maneuverable on the curved section of the wall with ease.

An object of the present disclosure is to provide a wall-climbing toy vehicle which may cross the obstacles coming between the wall and the wall-climbing toy vehicle, while climbing the wall.

Another object of the present disclosure is to provide a method for making wall-climbing toy vehicle or its components that include all the above objects.

In light of the above objects, in one aspect of the present disclosure, a wall-climbing vehicle controllable by a remote control over a vertical wall is provided. The wall-climbing vehicle includes a car body having a bottom portion. Further, the wall-climbing vehicle includes a bottom cover configured along the bottom portion. The bottom cover may be disposed along the bottom portion such that a gap between the vertical wall and the bottom portion of the wall-climbing vehicle may be configured to avoid obstacle along the vertical wall, when the wall-climbing vehicle is driven over the vertical wall. An air intake area may be configured along a middle portion of the bottom cover to enable symmetrical weight balance. The air intake area may be configured to accommodate a circular air intake arrangement. The circular air intake arrangement may include a circular configuration to create a large opening along the air intake area to increase an air suction volume along the air intake area. Furthermore, the wall-climbing vehicle includes a plurality of sealing cloths strips configured along sides of the bottom portion to form a closed area in the wall-climbing vehicle. The closed area may be continuously evacuated by the circular air intake arrangement to form a negative pressure. Moreover, a plurality of bumps and a plurality of dots may be provided. The plurality of bumps may be configured along the bottom cover and adjacent to the air intake area. The plurality of bumps may be configured to increase air suction and balance the negative pressure below the bottom cover, thus facilitating the wall-climbing vehicle to move over the vertical wall. Further, the plurality of dots may be configured along the bottom cover and adjacent to the air intake area. The plurality of dots and the plurality of bumps may be alternatingly aligned adjacent to each other. The plurality of dots may be configured to enable air flow separation to reduce the airflow into the air intake area to facilitate balancing of the wall-climbing vehicle over the vertical wall.

In one embodiment, the air intake area may include a cut-out having a substantially square shape.

In one embodiment, the wall-climbing vehicle may include a supporting structure provided along the air intake area. Such substantially square shaped cut-out may adapt the circular air intake arrangement to be supported over supporting structure to from the large opening along the air intake area.

In one embodiment, the circular air intake arrangement may include a motor, a fan electrically coupled to the motor to be driven by the motor, a motor base coupled to the motor to provide a base support to the motor, and a plurality of sealing rings to couple the bottom portion. In this embodiment, the wall-climbing vehicle may include a plurality of sealing cover. The circular air intake arrangement may be accommodated along the air intake area via the plurality of sealing rings of the circular air intake arrangement and the plurality of sealing cover of bottom of the wall-climbing vehicle.

In one embodiment, the plurality of bumps may be arranged in a plurality of rows on the bottom cover; and the plurality of dots may be arranged in a plurality of rows on the bottom cover. In this embodiment, each of the rows of the plurality of bumps and the plurality of dots may be alternatingly arranged adjacent to each other.

In one another embodiment, the plurality of bumps may be arranged in the plurality of rows on the bottom cover along both sides of the air intake area; and the plurality of dots may be arranged in the plurality of rows on the bottom cover along both sides of the air intake area. In this embodiment, each of the rows of the plurality of bumps and the plurality of dots may be alternatingly arranged adjacent to each other along both sides of the air intake area.

In one another aspect of the present disclosure, a bottom cover for a wall-climbing vehicle controllable by a remote control over a vertical wall is provided. The bottom cover may be configured along a bottom portion of wall-climbing vehicle such that a gap between the vertical wall and the bottom portion of the wall-climbing vehicle may be configured to avoid obstacle along the vertical wall. The bottom cover may include an air intake area, a plurality of bumps and a plurality of dots. The air intake area may be configured along a middle portion of the bottom cover to enable symmetrical weight balance. The air intake area may be configured to accommodate a circular air intake arrangement. The circular air intake arrangement may include a circular configuration, when accommodated along the air intake area creates a large opening along the air intake area to increase an air suction volume along the air intake area. Further, a plurality of bumps may be configured along the bottom cover and adjacent to the air intake area. The plurality of bumps may be configured to increase air suction and balance a negative pressure below the bottom cover to facilitate the wall-climbing vehicle to move over the vertical wall. Furthermore, the plurality of dots may be configured along the bottom cover and adjacent to the air intake area. The plurality of dots and the plurality of bumps are alternatingly aligned adjacent to each other. The plurality of dots may be configured to enable air flow separation to reduce the airflow into the air intake area to facilitate balancing of the wall-climbing vehicle over the vertical wall.

In one embodiment, the air intake area may include a cut-out having a substantially square shape.

In one embodiment, the plurality of bumps may be arranged in a plurality of rows on the bottom cover; and the plurality of dots may be arranged in a plurality of rows on the bottom cover. In this embodiment, each of the rows of the plurality of bumps and the plurality of dots may be alternatingly arranged adjacent to each other.

In one another embodiment, the plurality of bumps may be arranged in the plurality of rows on the bottom cover along both sides of the air intake area; and the plurality of dots may be arranged in the plurality of rows on the bottom cover along both sides of the air intake area. In this embodiment, each of the rows of the plurality of bumps and the plurality of dots may be alternatingly arranged adjacent to each other along both sides of the air intake area.

In one another aspect of the present disclosure, a method for making a bottom cover of a wall-climbing vehicle is provided. Such bottom cover capable of being configured along a bottom portion of wall-climbing vehicle such that a gap between the vertical wall and the bottom portion of the wall-climbing vehicle may be configured to avoid obstacle along the vertical wall. The method includes configuring an air intake area along a middle portion of the bottom cover, configuring a plurality of bumps along the bottom cover and adjacent to the air intake area, and configuring a plurality of dots along the bottom cover and adjacent to the air intake area. The plurality of dots and the plurality of bumps may be alternatingly aligned adjacent to each other.

In one embodiment, configuring the air intake area may include configuring a cut-out having a substantially square shape.

In one embodiment, configuring the plurality of bumps and the plurality of dots may include: forming the plurality of bumps in a plurality of rows on the bottom cover; forming the plurality of dots in a plurality of rows on the bottom cover, wherein each of the rows of the plurality of bumps and the plurality of dots are alternatingly formed adjacent to each other.

In one embodiment, configuring the plurality of bumps and the plurality of dots may include forming the plurality of bumps in the plurality of rows on the bottom cover along both sides of the air intake area and forming the plurality of dots in the plurality of rows on the bottom cover along both sides of the air intake area. Each of the rows of the plurality of bumps and the plurality of dots are alternatingly arranged adjacent to each other along both sides of the air intake area.

In one embodiment, the method further includes forming the bottom cover of a light-weight and rigid material, including plastic, wood and so forth.

This together with the other aspects of the present disclosure, along with the various features of novelty that characterize the present disclosure, is pointed out with particularity in the claims annexed hereto and forms a part of the present disclosure. For a better understanding of the present disclosure, its operating advantages, and the specified object attained by its uses, reference should be made to the accompanying drawings and descriptive matter in which there are illustrated exemplary embodiments of the present disclosure.

BRIEF DESCRIPTION OF THE DRAWINGS

The advantages and features of the present disclosure will become better understood with reference to the following detailed description taken in conjunction with the accompanying drawing, in which.

Like reference numerals refer to like parts throughout the description of several views of the drawing.

DETAILED DESCRIPTION OF THE DISCLOSURE

Figure 1:
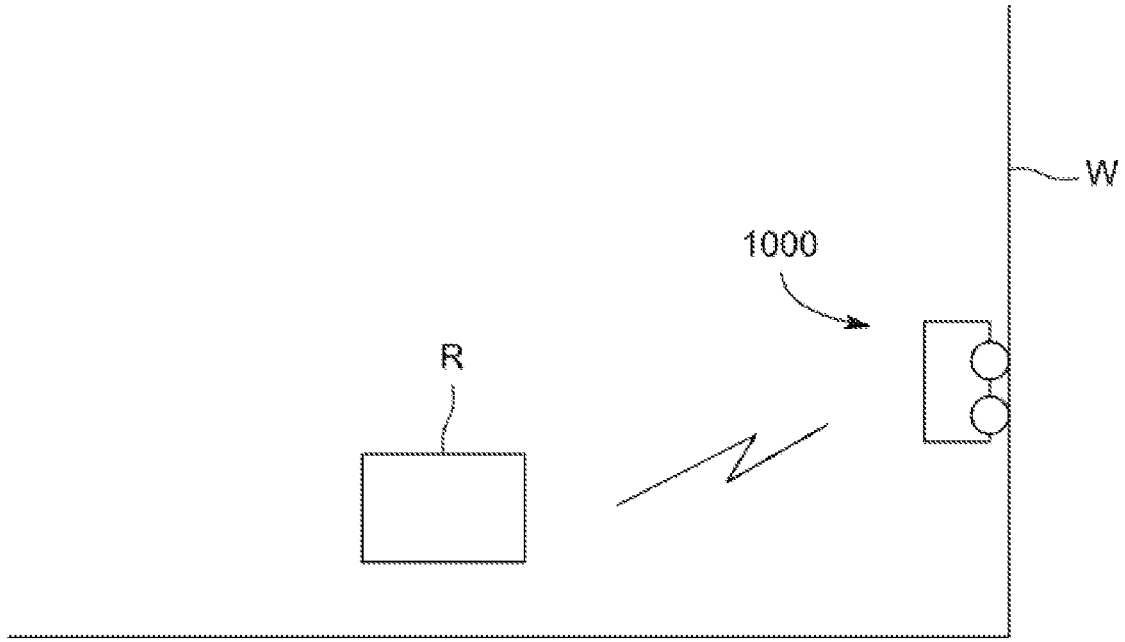
FIG. 1 illustrates an environment, wherein a wall-climbing vehicle is shown to climbing along a vertical wall, in accordance with an exemplary embodiment of the present disclosure.

The exemplary embodiments described herein detail for illustrative purposes are subject to many variations in implementation. The present disclosure provides a wall-climbing vehicle, and a bottom cover of such vehicle. The present disclosure also provides a method of making a bottom cover of the wall-climbing vehicle. It should be emphasized, however, that the present disclosure is not limited only to what is discloses and extends to cover various alternation to the wall-climbing vehicle and the bottom cover of such vehicle. It is understood that various omissions and substitutions of equivalents are contemplated as circumstances may suggest or render expedient, but these are intended to cover the application or implementation without departing from the spirit or scope of the present disclosure.

The terms "a" and "an" herein do not denote a limitation of quantity, but rather denote the presence of at least one of the referenced items.

The terms "having", "comprising", "including", and variations thereof signify the presence of a component.

In one aspect of the present disclosure, a wall-climbing vehicle controllable by a remote control over a vertical wall is provided. The wall-climbing vehicle includes a car body having a bottom portion. Further, the wall-climbing vehicle includes a bottom cover configured along the bottom portion. The bottom cover may be disposed along the bottom portion such that a gap between the vertical wall and the bottom portion of the wall-climbing vehicle may be configured to avoid obstacle along the vertical wall, when the wall-climbing vehicle is driven over the vertical wall. An air intake area may be configured along a middle portion of the bottom cover to enable symmetrical weight balance. The air intake area may be configured to accommodate a circular air intake arrangement. The circular air intake arrangement may include a circular configuration to create a large opening along the air intake area to increase an air suction volume along the air intake area. Furthermore, the wall-climbing vehicle includes a plurality of sealing cloths strips configured along the sides of the bottom portion to form a closed area in the wall-climbing vehicle. The closed area may be continuously evacuated by the circular air intake arrangement to form a negative pressure. Moreover, a plurality of bumps and a plurality of dots may be provided. The plurality of bumps may be configured along the bottom cover and adjacent to the air intake area. The plurality of bumps may be configured to increase air suction and balance the negative pressure below the bottom cover to facilitate the wall-climbing vehicle to move over the vertical wall. Further, the plurality of dots may be configured along the bottom cover and adjacent to the air intake area. The plurality of dots and the plurality of bumps may be alternatingly aligned adjacent to each other. The plurality of dots may be configured to enable air flow separation to reduce the airflow into the air intake area to facilitate balancing of the wall-climbing vehicle over the vertical wall.

In one another aspect of the present disclosure, a bottom cover for a wall-climbing vehicle controllable by a remote control over a vertical wall is provided. The bottom cover may be configured along a bottom portion of wall-climbing vehicle such that a gap between the vertical wall and the bottom portion of the wall-climbing vehicle may be configured to avoid obstacle along the vertical wall. The bottom cover may include an air intake area, a plurality of bumps and a plurality of dots. The air intake area may be configured along a middle portion of the bottom cover to enable symmetrical weight balance. The air intake area may be configured to accommodate a circular air intake arrangement. The circular air intake arrangement may include a circular configuration, when accommodated along the air intake area creates a large opening along the air intake area to increase an air suction volume along the air intake area. Further, the plurality of bumps may be configured along the bottom cover and adjacent to the air intake area. The plurality of bumps may be configured to increase air suction and balance a negative pressure below the bottom cover to facilitate the wall-climbing vehicle to move over the vertical wall. Furthermore, the plurality of dots may be configured along the bottom cover and adjacent to the air intake area. The plurality of dots and the plurality of bumps are alternatingly aligned adjacent to each other. The plurality of dots may be configured to enable air flow separation to reduce the airflow into the air intake area to facilitate balancing of the wall-climbing vehicle over the vertical wall.

In one another aspect of the present disclosure, a method for making a bottom cover of a wall-climbing vehicle is provided. Such bottom cover capable of being configured along a bottom portion of wall-climbing vehicle such that a gap between the vertical wall and the bottom portion of the wall-climbing vehicle may be configured to avoid obstacle along the vertical wall. The method includes configuring an air intake area along a middle portion of the bottom cover, configuring a plurality of bumps along the bottom cover and adjacent to the air intake area, and configured a plurality of dots along the bottom cover and adjacent to the air intake area. The plurality of dots and the plurality of bumps may be alternatingly aligned adjacent to each other.

Figure 2A:
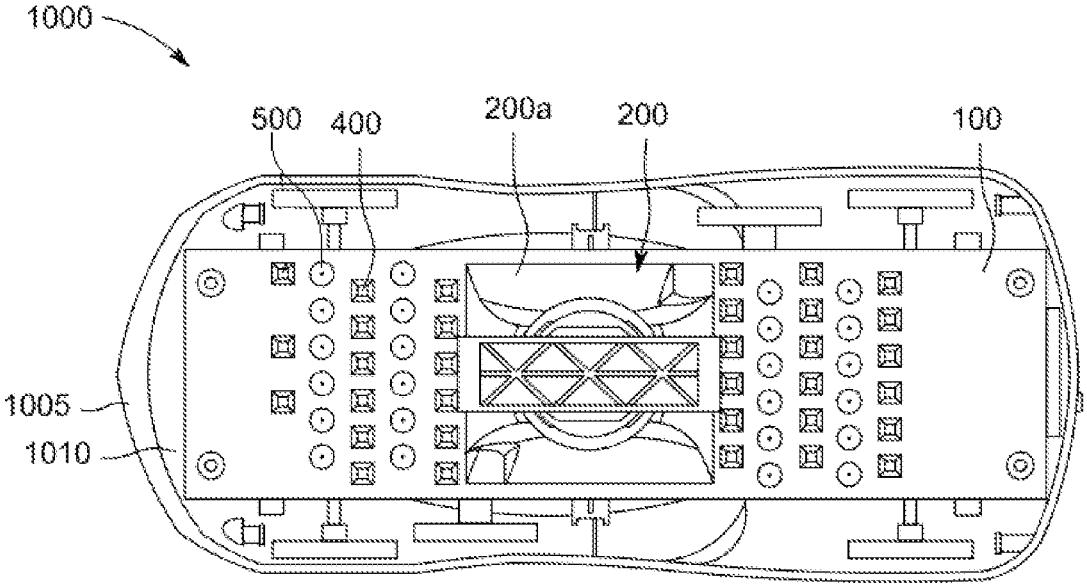
FIGS. 2A and 2B illustrate a bottom side of a wall-climbing vehicle depicting a bottom cover, in accordance with an exemplary embodiment of the present disclosure.
Figure 2B:
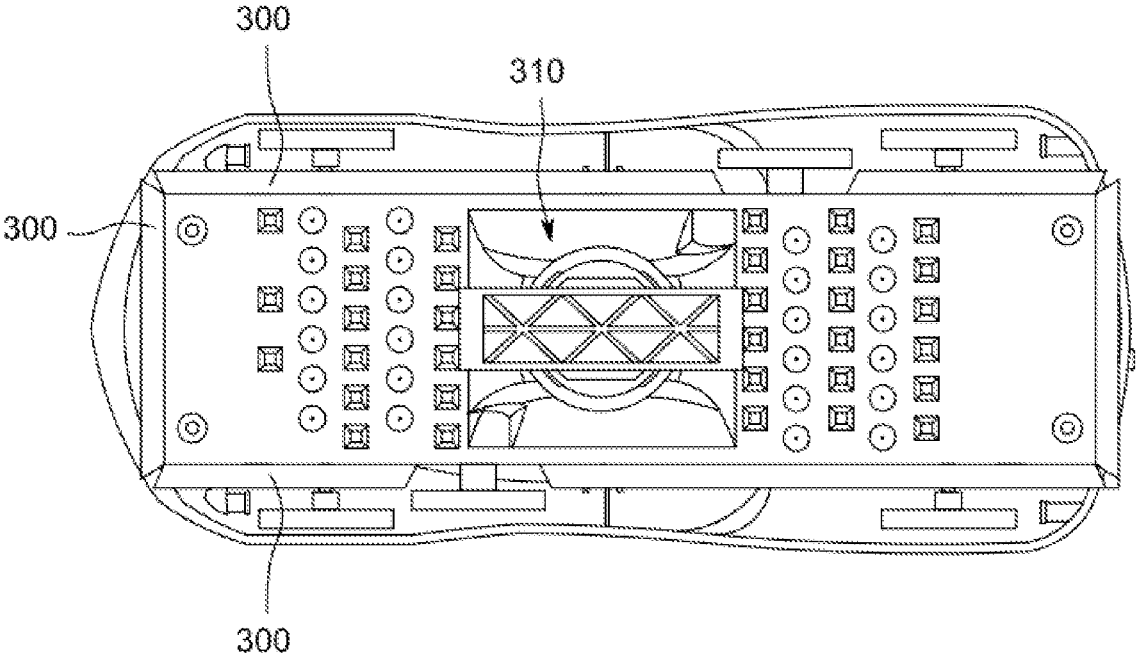
Figure 3:
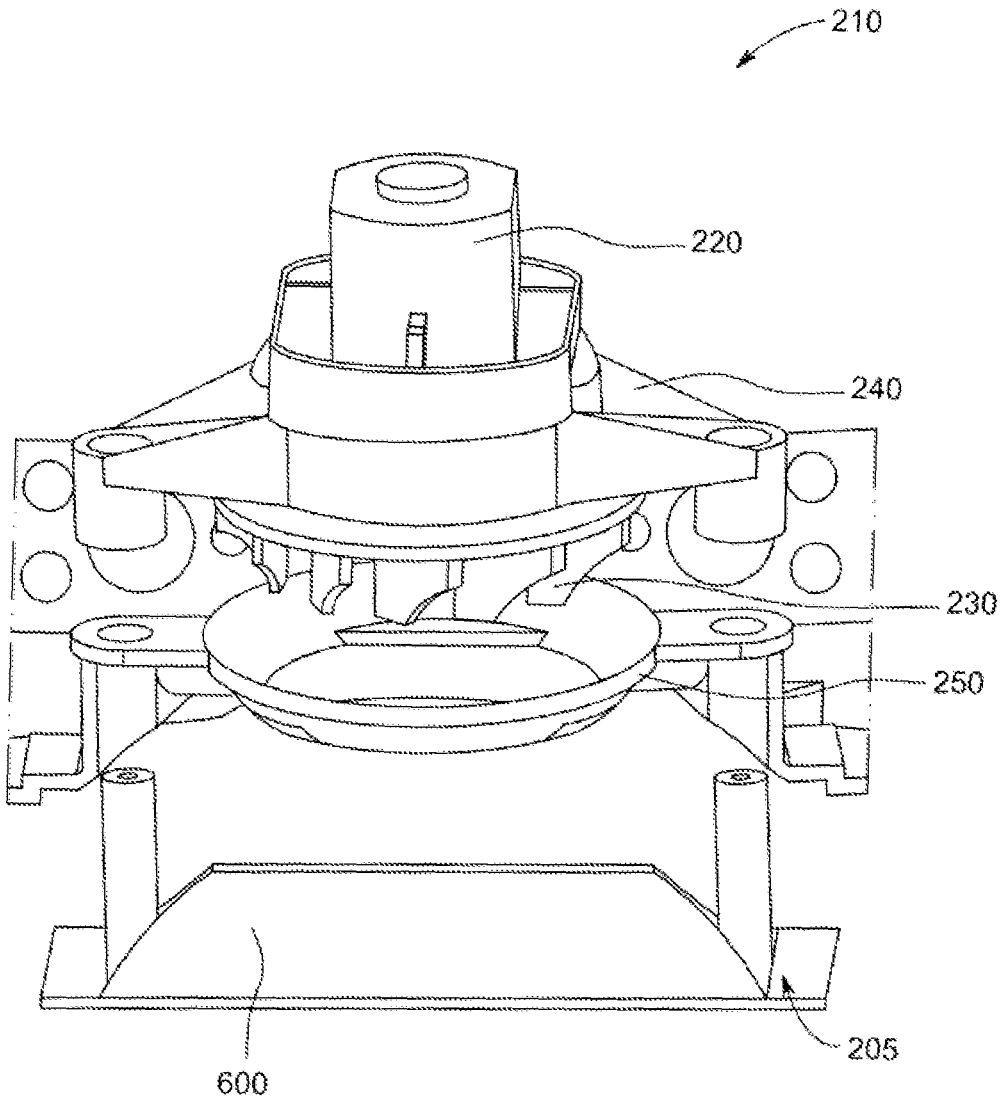
FIG. 3 illustrates a circular air intake arrangement of a wall-climbing vehicle, in accordance with an exemplary embodiment of the present disclosure.

A wall-climbing vehicle, and a bottom cover of such vehicle will now be described in conjunction with FIGS. 1 to 3. FIG. 1 illustrates an environment, wherein a wall-climbing vehicle is shown to climbing along a vertical wall, in accordance with an exemplary embodiment of the present disclosure. Further, FIGS. 2A and 2B illustrate a bottom side of a wall-climbing vehicle depicting a bottom cover, in accordance with an exemplary embodiment of the present disclosure. Furthermore, FIG. 3 illustrates a circular air intake arrangement of a wall-climbing vehicle, in accordance with an exemplary embodiment of the present disclosure.

As seen in FIG. 1, a wall-climbing vehicle 1000 is provided. The wall-climbing vehicle 1000 may be capable of climbing along a vertical wall 'W'. The wall-climbing vehicle 1000 may be controllable by a remote control 'R' over the vertical wall 'W'.

As seen in FIGS. 2A and 2B, the wall-climbing vehicle 1000, includes a car body 1005 having a bottom portion 1010. The wall-climbing vehicle 1000 will now be described in conjunction with FIGS. 1, 2A and 2B.

The wall-climbing vehicle 1000 includes a bottom cover 100 configured along the bottom portion 1010. The bottom cover 100 may be disposed along the bottom portion 1010 such that a gap between the vertical wall and the bottom portion 1010 of the wall-climbing vehicle 1000 is configured to avoid obstacle along the vertical wall, when the wall-climbing vehicle 1000 is driven over the vertical wall.

The wall-climbing vehicle 1000 may further include an air intake area 200 configured along a middle portion of the bottom cover 100 to enable symmetrical weight balance. In one embodiment, the air intake area 200 comprises a cut-out 200*a* having a substantially square shape. However, without departing from the scope of the present disclosure, the air intake area 200 may be of any other shape. Further, in one embodiment, the bottom cover may be made of a light-weight and rigid material, including plastic, wood and so forth.

The air intake area 200 may be configured to accommodate a circular air intake arrangement 210, as seen in FIG. 3. The circular air intake arrangement 210 may include a circular configuration to create a large opening along the air intake area 200 to increase an air suction volume along the air intake area 200. Specifically, the air intake area 200 with the cut-out 200*a* having the substantially square shape and the circular configuration of the air intake arrangement 210 create such large opening along the air intake area 200 to increase the air suction volume along the air intake area 200.

The circular air intake arrangement 210 may be explained herein later in conjunction with FIG. 3.

Further, as seen in FIGS. 2A and 2B, the wall-climbing vehicle 1000 may include a plurality of sealing cloths strips 300 configured along sides the bottom portion 1010 to form a closed area 310 (seen in FIG. 2B) in the wall-climbing vehicle 1000. The closed area 310 may be continuously evacuate by the circular air intake arrangement 210 to form a negative pressure.

Furthermore, as seen in FIGS. 2A and 2B, the wall-climbing vehicle 1000 may include a plurality of bumps 400 and a plurality of dots 500 configured along a bottom cover 100. In one embodiment, the plurality of bumps 400 and the plurality of dots 500 may be configured along the bottom cover 100 and adjacent to the air intake area 200. Further, the plurality of dots 500 and the plurality of bumps 400 are also alternatingly aligned adjacent to each other.

In one another embodiment, the plurality of bumps 400 may be arranged in a plurality of rows on the bottom cover 100. Further, the plurality of dots 500 may also be arranged in a plurality of rows on the bottom cover 100. In such embodiment, each of the rows of the plurality of bumps 400 and the plurality of dots 500 are alternatingly arranged adjacent to each other.

In one further embodiment, the plurality of bumps 400 may be arranged in the plurality of rows on the bottom cover 100 along both sides of the air intake area 200. Further, in such embodiment, the plurality of dots 500 may also be arranged in a plurality of rows on the bottom cover 100 along both sides of the air intake area 200. Furthermore, in such embodiments, each of the rows of the plurality of bumps 400 and the plurality of dots 500 may be alternatingly arranged adjacent to each other along both sides of the air intake area 200.

In one example embodiment, the plurality of bumps 400 may be configured to increase air suction and balance the negative pressure below the bottom cover 100 to facilitate the wall-climbing vehicle 100 to move over the vertical wall, and the plurality of dots 500 may be configured to enable air flow separation to reduce the airflow into the air intake area 200 to facilitate balancing of the wall-climbing vehicle 100 over the vertical wall.

Combinedly, the plurality of bumps 400 and the plurality of dots 500 works may work as similar to spoiler in an aeroplane. The plurality of bumps 400 and the plurality of dots 500 capable of balancing overall the wall-climbing vehicle 100 over the vertical wall in combination with the air intake area 200.

Referring now to FIG. 3, circular air intake arrangement 210 is show, and will be described herein in conjunction with FIGS. 2A and 2B. In one embodiment, the circular air intake arrangement 210 may include a motor 220, a fan 230 electrically coupled to the motor 220 to be driven by the motor 220, a motor base 240 coupled to the motor 220 to provide a base support to the motor 220, and a plurality of sealing rings 250 to couple the bottom portion 1010.

As also seen in FIG. 3, the wall-climbing vehicle 1000 may also include a supporting structure 205 aligned along the air intake area 200. The substantially square shaped cut-out 200*a* adapts the circular air intake arrangement 210 to be supported over supporting structure 205 to from the large opening along the air intake area 200.

As further seen in FIG. 3, the wall-climbing vehicle 1000 may also include a plurality of sealing cover 600. The circular air intake arrangement 210 may be accommodated along the air intake area 200 via the plurality of sealing rings 250 of the circular air intake arrangement 210 and the plurality of sealing cover 600 of bottom of the wall-climbing vehicle 1000.

In operation, when the wall-climbing vehicle 1000 is operated via the remote control 'R' over the vertical wall 'W', the air intake area 200 with the help of the circular air intake arrangement 210 to creates the large opening along the air intake area 200 to increase the air suction volume along the air intake area 200. Further, the closed area 310 is continuously evacuate by the circular air intake arrangement 210 to form a negative pressure. Furthermore, the plurality of bumps 400 are configured to increase air suction and balance the negative pressure below the bottom cover 100 to facilitate the wall-climbing vehicle 100 to move over the vertical wall 'W'. Moreover, the plurality of dots 500 configured to enable air flow separation to reduce the airflow into the air intake area 200 to facilitate balancing of the wall-climbing vehicle 100 over the vertical wall.

In one embodiment, a bottom cover, such as the bottom cover 100 may be provided. Such bottom cover 100 may be configured along a wall-climbing vehicle, such as the wall-climbing vehicle 1000. The bottom cover may include an air intake area, such as the air intake area 200, a plurality of bumps, such as the plurality of bumps 400, and a plurality of dots, such as the plurality of dots 500, as described above. For the sake of brevity of the present disclosure and avoid repetition, such components are excluded from description herein.

In one further embodiment a method for making a bottom cover, such as the bottom cover 100, of a wall-climbing vehicle, such as the wall-climbing vehicle 1000, is provided. The method for making such bottom cover includes configuring an air intake area, such as the air intake area 200, along a middle portion of the bottom cover 100. Further, the method includes configuring a plurality of bumps, such as the plurality of bumps 400, along the bottom cover 100 and adjacent to the air intake area 200 and configuring a plurality of dots, such as the plurality of dots 500, along the bottom cover 100 and adjacent to the air intake area 200. The air intake area, such as the air intake area 200, the plurality of bumps, such as the plurality of bumps 400, and the plurality of dots, such as the plurality of dots 500, are similar to what described herein above, and for the sake of brevity of the present disclosure and avoid repetition, such components are excluded from description herein.

The present disclosure is advantageous in providing a wall-climbing toy vehicle which may create substantial amount of suction effect to withhold the wall during climbing the wall. The present disclosure is advantageous in providing a wall-climbing toy vehicle which may be able to balance with greater suction volume and be maneuverable on the curved section of the wall with ease. The present disclosure is advantageous in providing a wall-climbing toy vehicle which may cross the obstacles coming between the wall and the wall-climbing toy vehicle, while climbing the wall. The present disclosure is advantageous in providing a method for making wall-climbing toy vehicle or its components that include all the above objects.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, and to thereby enable others skilled in the art to best utilize the present disclosure and various embodiments with various modifications as are suited to the particular use contemplated. It is understood that various omissions and substitutions of equivalents are contemplated as circumstances may suggest or render expedient, but such omissions and substitutions are intended to cover the application or implementation without departing from the spirit or scope of the present disclosure.

What is claimed is:

1. A wall-climbing vehicle controllable by a remote control over a vertical wall, the wall-climbing vehicle, comprising:

a car body having a bottom portion;

a bottom cover configured along the bottom portion, the bottom cover includes a middle portion and a peripheral portion;

the bottom cover is disposed along the bottom portion such that a gap between the vertical wall and the bottom portion of the wall-climbing vehicle is configured to avoid obstacles along the vertical wall, when the wall-climbing vehicle is driven over the vertical wall;

the middle portion includes an air intake area defining a cut-out;

the air intake area enables symmetrical weight balance, the air intake area configured to accommodate a circular air intake arrangement, wherein the circular air intake arrangement includes a circular configuration to create a large opening along the air intake area to increase an air suction volume along the air intake area;

the circular air intake arrangement includes a sealing ring and a sealing cover;

the sealing ring is coupled to a bottom portion of the circular air intake arrangement and the sealing ring when assembled to the bottom cover, is located in the cut-out of the middle portion of the bottom cover;

the peripheral portion of the bottom cover includes a plurality of bumps and a plurality of dots arranged underside of the bottom cover;

the circular air intake arrangement is accommodated along the air intake area via the sealing ring and the sealing cover of the wall-climbing vehicle;

a plurality of sealing cloth strips configured along sides of the bottom portion to form a closed area in the wall-climbing vehicle, wherein the closed area is continuously evacuated by the circular air intake arrangement to form a negative pressure;

the plurality of bumps configured along the bottom cover and adjacent to the air intake area, the plurality of bumps configured to increase air suction and balance the negative pressure below the bottom cover to facilitate the wall-climbing vehicle to move over the vertical wall;

the plurality of dots configured along the bottom cover and adjacent to the air intake area, the plurality of dots and the plurality of bumps alternatingly aligned adjacent to each other, the plurality of dots configured to enable air flow separation to reduce the airflow into the air intake area to facilitate balancing of the wall-climbing vehicle over the vertical wall.

2. The wall-climbing vehicle of claim 1, wherein the cut-out is of a square shape.

3. The wall-climbing vehicle of claim 2 further comprising a supporting structure provided along the air intake area, wherein the square shaped cut-out adapts the circular air intake arrangement to be supported over the supporting structure to form the large opening along the air intake area.

4. The wall-climbing vehicle of claim 1, wherein the circular air intake arrangement further comprises:

a motor;

a fan electrically coupled to the motor to be driven by the motor;

a motor base coupled to the motor to provide a base support to the motor.

5. The wall-climbing vehicle of claim 1, wherein the plurality of bumps is arranged in a plurality of rows on the bottom cover;

the plurality of dots is arranged in a plurality of rows on the bottom cover.

6. The wall-climbing vehicle of claim 5, wherein each of the rows of the plurality of bumps and the plurality of dots are alternatingly arranged adjacent to each other.

7. The wall-climbing vehicle of claim 1, wherein the plurality of bumps is arranged in a plurality of rows on the bottom cover along both sides of the air intake area;

the plurality of dots is arranged in a plurality of rows on the bottom cover along both sides of the air intake area.

8. The wall-climbing vehicle of claim 7, wherein each of the rows of the plurality of bumps and the plurality of dots are alternatingly arranged adjacent to each other along both sides of the air intake area.

9. A bottom cover for a wall-climbing vehicle controllable by a remote control over a vertical wall, the bottom cover configured along a bottom portion of the wall-climbing vehicle, the bottom cover comprising a middle portion and a peripheral portion;

the bottom cover is disposable along the bottom portion such that a gap between the vertical wall and the bottom portion of the wall-climbing vehicle is configured to avoid obstacles along the vertical wall;

the middle portion includes an air intake area defining a cut-out;

the air intake area enables symmetrical weight balance, the air intake area configured to accommodate a circular air intake arrangement, wherein the circular air intake arrangement includes a circular configuration, when accommodated along the air intake area creates a large opening along the air intake area to increase an air suction volume along the air intake area;

the circular air intake arrangement includes a sealing ring and a sealing cover;

the sealing ring is coupled to a bottom portion of the circular air intake arrangement and the sealing rings when assembled to the bottom cover, is located in the cut-out of the middle portion of the bottom cover;

the peripheral portion of the bottom cover includes a plurality of bumps and a plurality of dots arranged underside of the bottom cover;

the circular air intake arrangement is accommodated along the air intake area via the sealing ring and the sealing cover of the wall-climbing vehicle;

the plurality of bumps configured along the bottom cover and adjacent to the air intake area, the plurality of bumps configured to increase air suction and balance a negative pressure below the bottom cover to facilitate the wall-climbing vehicle to move over the vertical wall; and the plurality of dots configured along the bottom cover and adjacent to the air intake area, the plurality of dots and the plurality of bumps alternatingly aligned adjacent to each other, the plurality of dots configured to enable air flow separation to reduce the airflow into the air intake area to facilitate balancing of the wall-climbing vehicle over the vertical wall.

10. The bottom cover of claim 9, wherein the cut-out is of a square shape.

11. The bottom cover of claim 9, wherein the plurality of bumps is arranged in a plurality of rows on the bottom cover; and the plurality of dots is arranged in a plurality of rows on the bottom cover.

12. The bottom cover of claim 11, wherein each of the rows of the plurality of bumps and the plurality of dots are alternatingly arranged adjacent to each other.

13. The bottom cover of claim 9, wherein the plurality of bumps is arranged in a plurality of rows on the bottom cover along both sides of the air intake area; and the plurality of dots is arranged in a plurality of rows on the bottom cover along both sides of the air intake area.

14. The bottom cover of claim 13, wherein each of the rows of the plurality of bumps and the plurality of dots are alternatingly arranged adjacent to each other along both sides of the air intake area.

* * * * *